US006224397B1

(12) United States Patent
Nakamura

(10) Patent No.: US 6,224,397 B1
(45) Date of Patent: May 1, 2001

(54) BRANCHING CONNECTOR AND ELECTRICAL CONNECTOR BOX ASSEMBLY

(75) Inventor: Masayoshi Nakamura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/495,000

(22) Filed: Jan. 31, 2000

(30) Foreign Application Priority Data

Feb. 1, 1999 (JP) ..... 11-023785

(51) Int. Cl.[7] ..... H01R 12/00
(52) U.S. Cl. ..... 439/76.2; 439/949
(58) Field of Search ..... 439/76.2, 949, 439/910

(56) References Cited

U.S. PATENT DOCUMENTS 4,781,621 * 11/1988 Sugiyama et al. ..... 439/76.2
5,023,752 * 6/1991 Detter et al. ..... 439/76.2
5,403,193 * 4/1995 Ito et al. ..... 439/76.2
5,618,186 * 4/1997 Saka et al. ..... 439/76.2

FOREIGN PATENT DOCUMENTS 62-177226 11/1987 (JP) .
0160383 * 6/1990 (JP) .
7-5652 2/1995 (JP) .

* cited by examiner

*Primary Examiner*—Tulsidas Patel
(74) *Attorney, Agent, or Firm*—Bierman, Muserlian and Lucas

(57) ABSTRACT

Connection terminals 25 extending from bus bars 23 are projected from an upper case 21. A circuit board 24*a* closest to the upper case 21 is formed integrally with terminal supports 32 supporting the connection terminals 25 perpendicularly on the circuit board 24*a*. Insertion openings 35 are formed at the bottom of connector mounting openings 27 through which the connection terminals 25 project. The terminal supports 32 supporting the connection terminals 25 are inserted through the insertion openings 35. The terminal supports 32 and the insertion openings 35 are disposed so that, when an inner side surface of the upper case 21 abuts the upper surface of a circuit unit 20 and the two are assembled with proper alignment, upper end surfaces 32*a* of the terminal supports 32 are coplanar with a bottom surface 27*a* on which are disposed the insertion openings 35, thereby allowing for visual confirmation of proper alignment.

3 Claims, 5 Drawing Sheets

BRANCHING CONNECTOR AND ELECTRICAL CONNECTOR BOX ASSEMBLY

This application claims the benefit of the priority of Japanese Patent Application No. 11-23785 filed Feb. 1, 1999.

The present invention relates to a branching connector having a circuit unit and a connector for a wire harness and to an electrical connection box which houses the branching connector.

BACKGROUND OF THE INVENTION

Conventionally, automobiles use electrical connection boxes, such as relay boxes and fuse boxes. An electrical connection box houses a branching connector, on which a plurality of relays, fuses, and the like are mounted and to which wire harnesses, coming in from outside, are connected. The branching connector houses a circuit unit from which a plurality of connector terminals project, both above and below the outer surface of the circuit unit. These connector terminals also project through the upper case of the branching connector to connect fuses, relays and the like and into the lower case of the branching connector. The circuit unit is formed by stacking a plurality of circuit boards, one on top of the other. Circuits are formed from a plurality of bus bars, which make up the circuit board, and the connector terminals extend from the bus bars.

Generally, the inner surface of the branching connector abuts the upper surface of the circuit unit and the connector terminals project through the upper case of the branching connector. The individual connector terminals are positioned in and can form, for example, relay cavities, fuse cavities, or connector mounting openings. These fuse cavities, relay cavities and connector mounting openings are generally part of the upper case into which the fuses and connectors are positioned.

When assembling the branching connector, the circuit unit is positioned inside an upper case and a lower case, and the upper and lower cases are connected and fixed to each other by pairs of elastic engagement pieces disposed on each of the cases. If the branching connector is assembled so that the upper surface and the lower surface of the circuit unit do not tightly abut the inner surfaces of the upper case and the lower case, the connector terminals will not project a predetermined length through the case. As a result, the relays, fuses, and the like will not be reliably connected to the connector terminals.

When assembling the branching connector, a tool is used to apply a predetermined load to cause the elastic engagement pieces on the cases to connect. Since it is not possible to confirm whether the upper case, the lower case, and the circuit unit are properly aligned before connecting the two cases, it must be assumed that the circuit unit and the upper and lower cases are aligned when the elastic engagement pieces are aligned and the tool connects the upper and lower cases. Furthermore, since the elastic engagement pieces are disposed on the sides of the cases, it is not possible to confirm whether the central portions of the circuit unit are properly positioned in the casing, even when the elastic engagement pieces are engaged. There is thus a need to provide a branching connector wherein the circuit unit and the upper and lower cases can be properly assembled in a reliable manner.

SUMMARY OF THE INVENTION

The present invention accomplishes this by providing an extension on the circuit unit which extends through the upper case and aligns with a corresponding hole in the upper case. The extension has a top surface that is substantially flat and coplanar with the outer surface of the upper case. With this coplanar arrangement, proper assembly can be visually confirmed, either by the human eye or by a conventional inspection machine. Furthermore, since the extension is preferably positioned in close association with the connector terminals, the extension also allows for confirmation that the central portions of the circuit unit tightly abut the upper case.

As used herein, the term coplanar means that the top surface of the extension is in the same plane as at least a portion of the outer surface of the upper case.

Broadly, the present invention is a branching connector comprising a casing in which a circuit unit is housed, wherein the circuit unit is a plurality of stacked circuit boards on which bus bars form circuits; connecting terminals extend from the circuit boards and project from the surface of the circuit unit in the direction in which the circuit boards are stacked; the connecting terminals project through the outer surface of the casing to form connectors for electronic members; one or more extensions are disposed on the circuit boards, the extensions extending from the surface of the circuit unit in stacking direction; and insertion openings are disposed on the casing to allow for insertion of the extensions therethrough, the relative heights of the extensions and the insertion openings being such that the top of each extension is coplanar with a portion of the outer surface of the casing at the insertion opening to provide for visual inspection from the front of the branching connector and thereby confirm proper assembly.

Preferably, the extensions are terminal supports formed integrally with one or more of the circuit boards through which the connecting terminals are inserted, the terminal supports supporting the connecting terminals so that they are perpendicular to the circuit board.

More preferably, the terminal supports are formed integrally with the uppermost circuit board, i.e. the circuit board that forms the upper surface of the circuit unit.

Still more preferably, the extensions extend through the casing at a point where the inner surface of the casing abuts the upper surface of the circuit unit, and even more preferably, where there is a connector mount opening.

The electrical connection box according to the present invention includes a branching connector as described herein.

According to the preferred embodiment, when a connector mounting opening is integrated with the upper casing of the branching connector, the extension extends from the surface of the circuit unit and into the insertion opening of the connector mounting opening.

The extension can be: (1) a terminal support disposed integrally with a circuit board to provide perpendicular support for a connector terminal; (2) an extension disposed integrally with the circuit board and not associated with the connector terminal; or (3) an extension extending from the bus bar itself. The extension can extend, for example, from a surface on one side of the circuit unit, relative to the direction in which the bodies are stacked.

BRIEF DESCRIPTION OF THE DRAWINGS

These and other aspects of the present invention may be understood with reference to the accompanying drawings wherein.

DETAILED DESCRIPTION OF THE INVENTION

Figure 3:
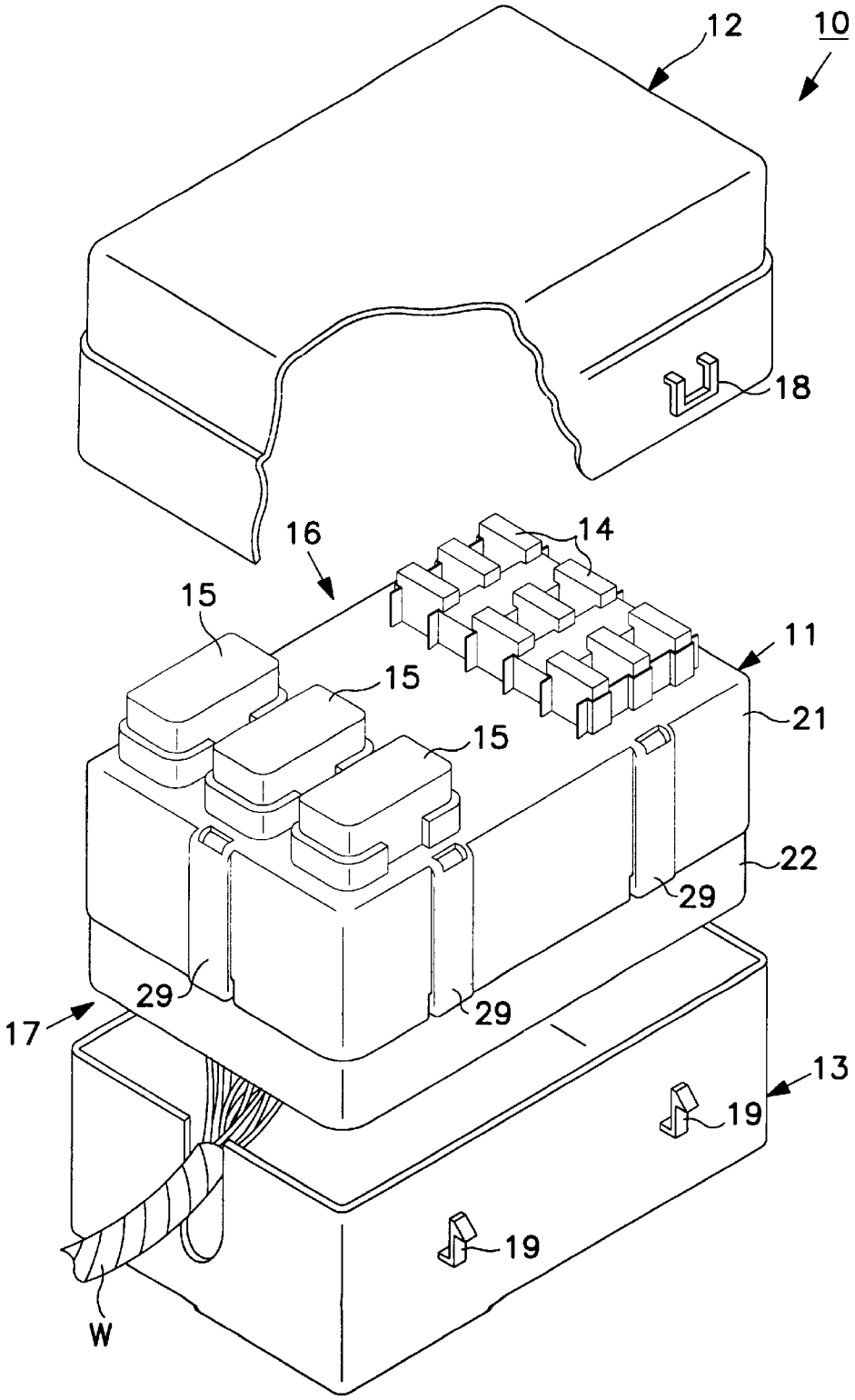
FIG. 3 is a schematic perspective view showing an electrical connection box.

As shown in FIG. 3, electrical connection box 10 is formed from branching connector 11, upper cover 12, and lower cover 13. Branching connector 11 is formed from upper connector 16 and lower connector 17. Fuses 14 and connectors 15 are mounted on upper connector 16. External connectors (not shown) connect a wire harness W to lower connector 17.

Fuses 14 and connector 15 are covered by upper cover 12. Lower cover 13 covers the external connectors of lower connector 17. Lower cover 13 is formed so that the wire harness W can be passed through, as shown.

Upper cover 12 and lower cover 13 are connected to each other, with branching connector 11 housed inside, by elastic engagement pieces 18 (only one is shown in FIG. 3), which are formed integrally with upper cover 12, and engagement pieces 19, which are formed integrally with lower cover 13.

Figure 4:
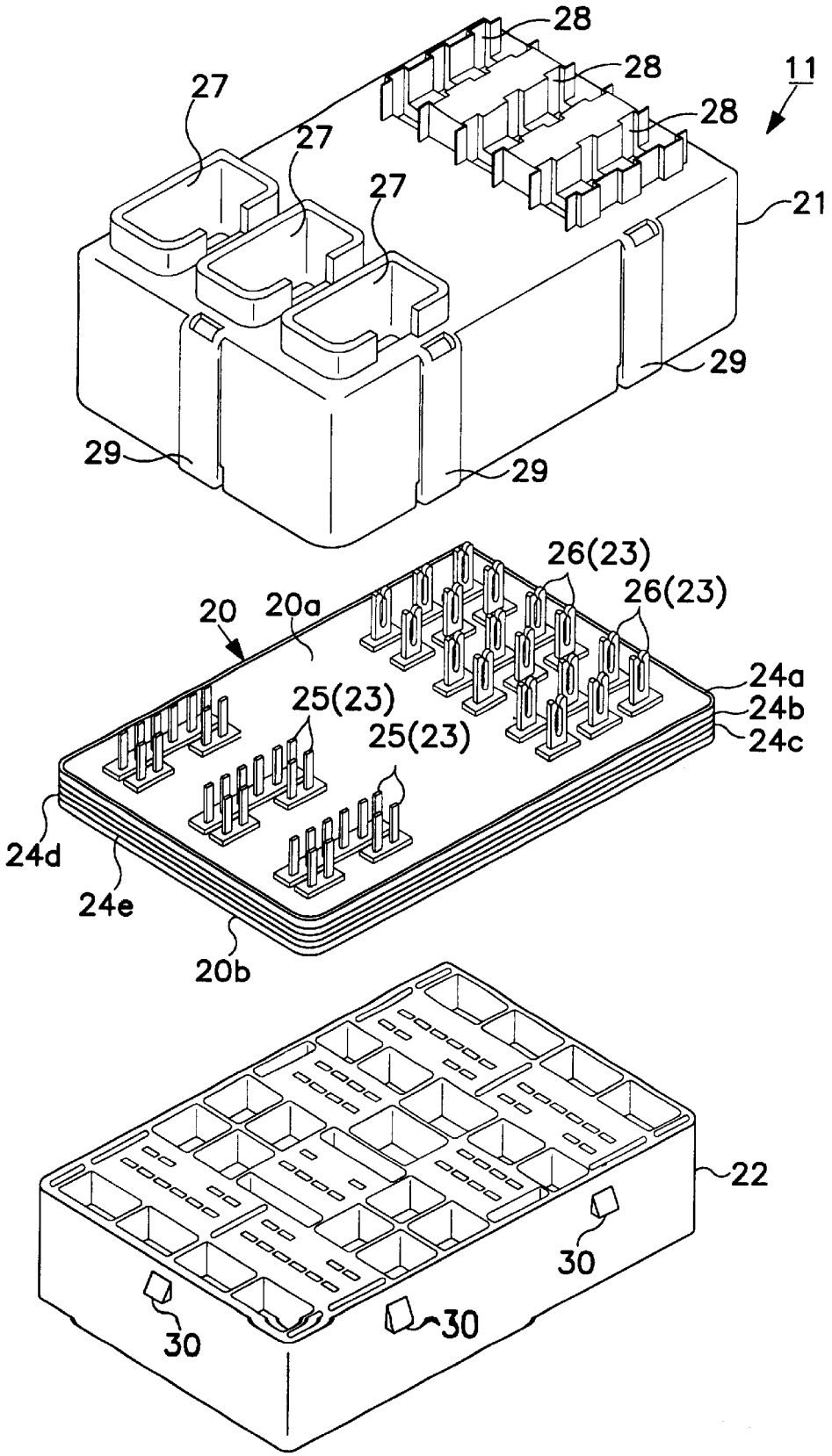
FIG. 4 is a schematic exploded perspective view of the branching connector.

FIG. 4 shows branching connector 11 in a disassembled state. Branching connector 11 includes circuit unit 20, upper case 21, and lower case 22. In this embodiment, upper case 21 and lower case 22 form the upper and lower connectors.

Circuit unit 20 is formed by stacking a plurality of circuit boards 24*a*–24*e*. Circuits are formed on circuit boards 24*a*–24*e* by a plurality of bus bars 23. Circuit boards 24*a*–24*e* are formed from insulative synthetic resin, and the plurality of bus bars 23 are arranged on the upper surfaces thereof. Extending from bus bars 23 are connector terminals 25, 26. Connector terminals 25, 26 extend upward and downward, perpendicular to circuit boards 24*a*–24*e*. Connector terminals 25, 26 of bus bars 23 are inserted through circuit boards 24*a*–24*e* and project from the upper surface of uppermost circuit board 24*a* and from the lower surface of lowermost circuit board 24*e*. On the circuit board 24*e*, at the lowermost position of the circuit unit 20, bus bars 23 are also disposed on the lower surface, forming circuits. Thus, upper surface 20*a* of circuit unit 20 is formed from the circuits of uppermost circuit board 24*a*, and lower surface 20*b* is similarly formed from the circuits on the lower surface of lowermost circuit board 24*e*. In this embodiment, upper surface 20*a* and lower surface 20*b* of circuit unit 20 are circuit surfaces.

Upper case 21 is formed integrally from synthetic resin and includes connector mounting openings 27 and fuse cavities 28, which serve as upper connector 16. Connector terminals 25 are disposed in connector mounting openings 27, and connector terminals 26 are disposed in fuse cavities 28.

Lower case 22 is also formed integrally from a synthetic resin and includes connector mounting openings (not shown), which serve as lower connector 17 of circuit unit 20.

Upper case 21 and lower case 22 are connected to each other so that they abut upper surface 20*a* and lower surface 20*b* respectively. When upper case 21 and lower case 22 abut upper surface 20*a* and lower surface 20*b* of circuit unit 20, elastic engagement pieces 29, which are formed integrally with the side surfaces of upper case 21, engage engagement pieces 30, which are formed integrally with the side surfaces of lower case 22, thus connecting cases 21 and 22 to each other.

Figure 1:
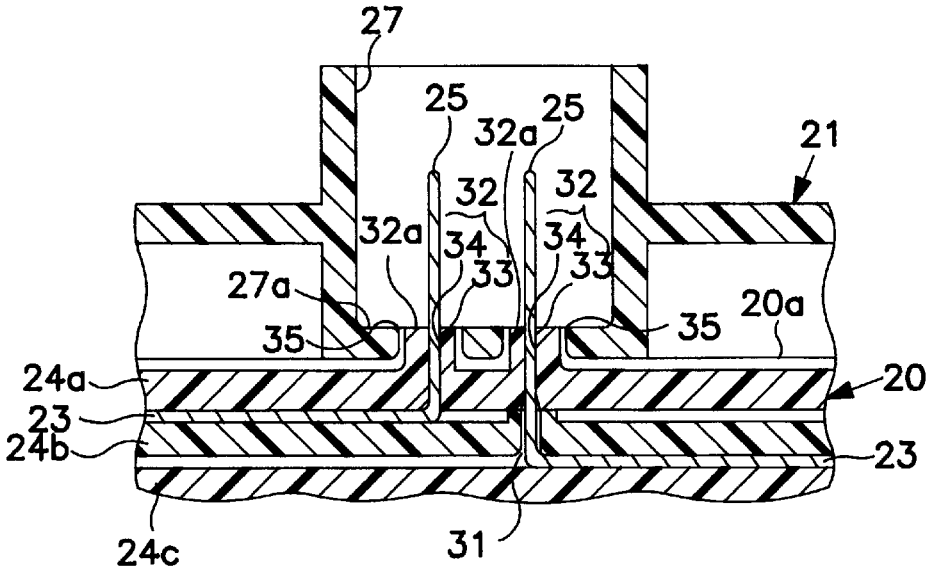
FIG. 1 is a schematic vertical cross-section of a connector mounting opening showing an extension as a terminal support in an insertion opening.

FIG. 1 is a schematic vertical cross-section showing one of connector mounting openings 27 disposed on upper case 21 and sections of circuit boards 24*a*, 24*b*, 24*c*, which serve as the upper portion of circuit unit 20.

Connector terminals 25 extend from bus bars 23, which serve as the circuits on circuit boards 24*a*–24*e*, and have a width greater than the thickness of the boards. One of connector terminals 25 extends from bus bar 23 on circuit board 24*c* and passes through insertion opening 31 disposed on circuit board 24*b*. Connector terminals 25 project a predetermined length above upper surface 20*a*. Insertion opening 31 is formed with a width slightly greater than that of connector terminals 25 and with a thickness slightly greater than that of connector terminals 25. This is done to take into account dimension tolerances in the circuit boards 24*a*–24*e*, which are formed by molding synthetic resin, as well as tolerances in assembly, thus allowing easier assembly.

Aligned with connector terminals 25 of bus bars 23, terminal supports 32 are formed integrally as extensions on circuit board 24*a*. Each terminal support 32 includes an extension 33 formed on the upper surface of circuit board 24*a* and a support opening 34 formed in the center of extension 33. The size of support opening 34 is such that connector terminal 25 can be pressed through. Thus, terminal supports 32 are formed so that they can support connector terminals 25 perpendicularly relative to circuit board 24*a*.

Terminal supports 32 are inserted through insertion openings 35. Insertion openings 35 allow for molding tolerances in upper case 21 and circuit boards 24*a*–24*e* as well as assembly tolerances. To make assembly easier, insertion openings 35 are formed larger than the horizontal cross section of extensions 33. Terminal supports 32 are formed so that when the inner surface of upper case 21 is tightly abutted against upper surface 20*a* of circuit unit 20, each upper end surface 32*a* of terminal supports 32 is at the same height as bottom surface 27*a* of connector mounting opening 27, i.e. surfaces 32*a* and 27*a* are coplanar.

As with connector terminals 25 exposed in connector mounting openings 27 of upper case 21, connector terminals exposed at connector mounting openings of lower case 22 are supported by terminal supports 32 formed integrally with circuit board 24*e* disposed at the lowermost position of circuit unit 20. Terminal supports 32 are inserted into insertion openings 35 disposed in connector mounting openings 27 at the corresponding positions.

The following is a description of how the branching connector and electrical connection box as described above operate.

Figure 2:
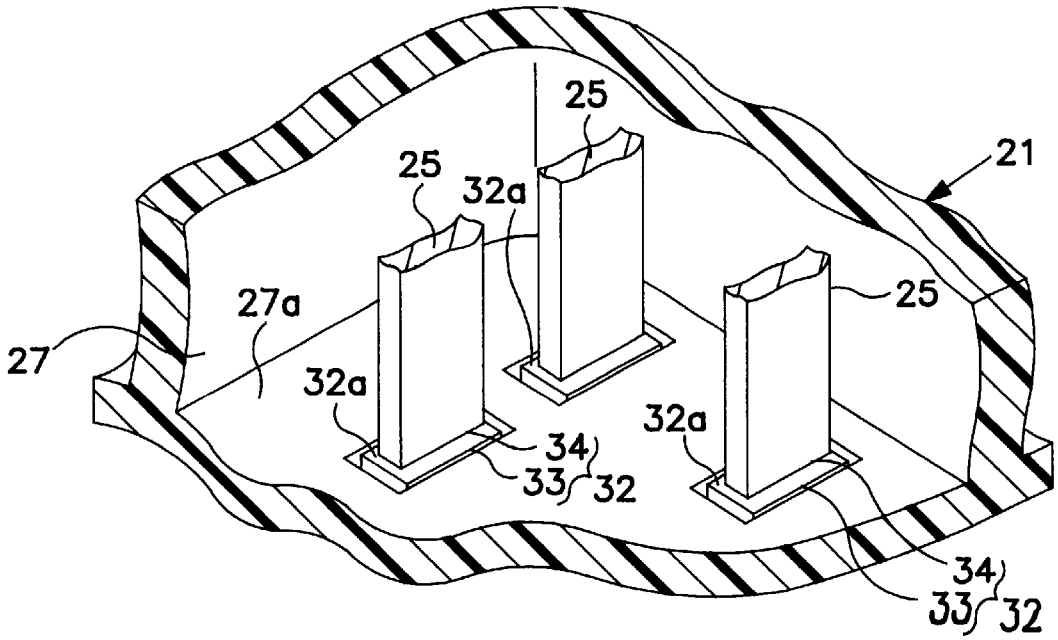
FIG. 2 is a schematic perspective view of a connector mounting opening showing an extension as a terminal support in an insertion opening.

To assemble branching connector 11, circuit unit 20 is assembled with upper case 21 so that the inner surface of upper case 21 abuts upper surface 20*a* of circuit unit 20. This causes terminal supports 32, through which connector terminals 25 are inserted, to be inserted into insertion openings 35 of connector mounting openings 27. As shown in FIG. 2, when circuit unit 20 and upper case 21 are assembled together, it is possible to look from the front of upper case 21 to visually inspect the relative heights (along the direction in which circuit unit 20 and upper case 21 are stacked) of terminal supports 32 and insertion openings 35, i.e. the relative heights of upper surface 32*a* and bottom surface 27*a*. When the height of upper end surface 32*a* is even (coplanar) with the height of bottom surface 27*a*, the inner surface of upper case 21 is abutted tightly against upper surface 20*a* of circuit unit 20. If upper end surface 32*a* is lower than bottom surface 27*a*, the inner surface of upper case 21 is not abutted tightly against upper surface 20*a* of circuit unit 20. Thus, the manner in which circuit unit 20 and upper case 21 are assembled can be directly inspected at terminal supports 32 of upper surface 20*a*.

The length of terminal supports 32 can be minimized since terminal supports 32 are formed integrally with circuit board 24*a*, which is closest to upper case 21. As a result, when circuit unit 20 and upper case 21 are assembled with proper alignment, the relative heights of terminal supports 32 and insertion openings 35 are not significantly affected by variations in the lengths of terminal supports 32. This allows the relative heights of terminal supports 32 and insertion openings 35 to effectively reflect the state of the assembly, which can then be visually evaluated.

Similarly, the manner in which circuit unit 20 and lower case 22 are assembled can be evaluated directly from terminal supports 32, which are disposed on lower surface 20*b* and which extend through insertion openings disposed on lower connector 17.

When circuit unit 20 and upper case 21, as well as circuit unit 20 and lower case 22, are properly assembled, elastic engagement pieces 29 of upper case 21 are engaged with engagement pieces 30 of lower case 22, thus integrating upper case 21 and lower case 22 in a properly assembled state.

Figure 5:
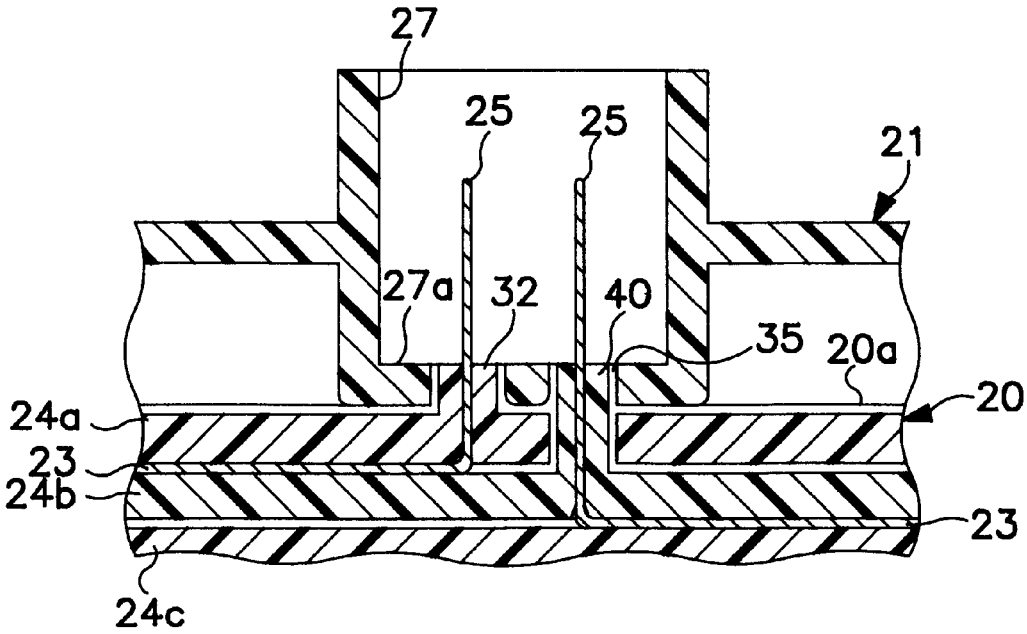
FIG. 5 is a schematic vertical cross-section view of another example of a connector mounting opening showing an extension as a terminal support in an insertion opening.

As shown in FIG. 5, terminal support 40 is formed integrally with circuit board 24*b* on the side from which connector terminals 25 extend. Terminal support 40 extends through insertion opening 35 of upper case 21, through which connector terminal 25 is inserted. The relative heights of terminal support 40 and insertion opening 35 can be checked from the front of upper case 21.

Figure 6:
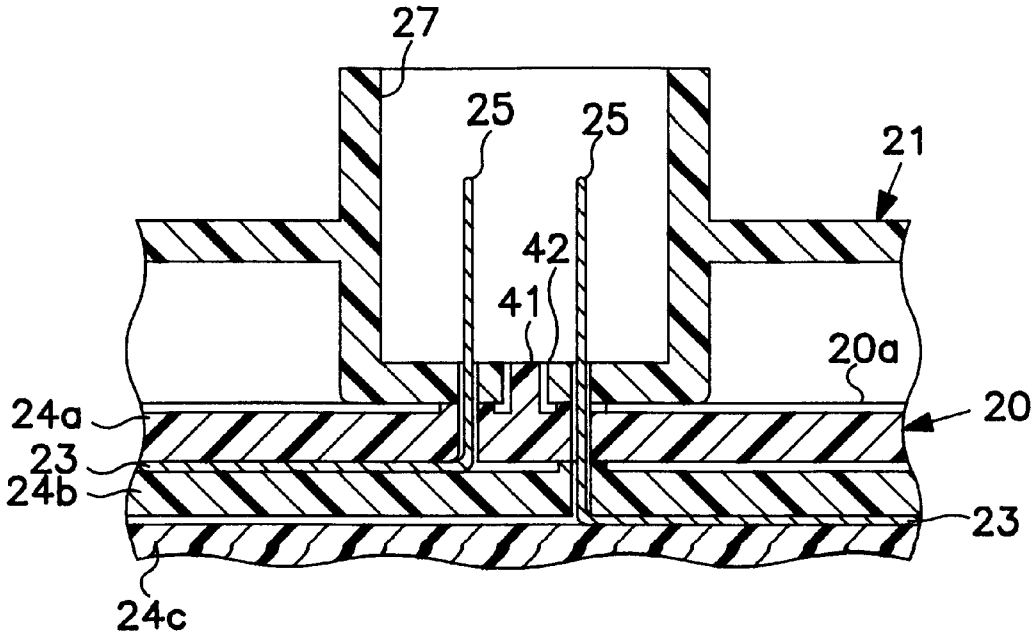
FIG. 6 is a schematic vertical cross-section view of yet another example of a connector mounting opening showing an extension as a terminal support in an insertion opening.

As shown in FIG. 6, extension 41 is formed integrally with circuit board 24*a*. Extension 41 extends in the direction in which the circuit boards are stacked and is disposed at a position where no connector terminal 25 is inserted. Upper case 21 is formed with insertion opening 42, through which extension 41 is inserted. As shown in FIG. 6, the upper end of extension 41 can be lower than the upper opening of insertion opening 42 or can be at the same position. The relative heights of extension 41 and insertion opening 42 are checked from the front of upper case 21.

Figure 7:
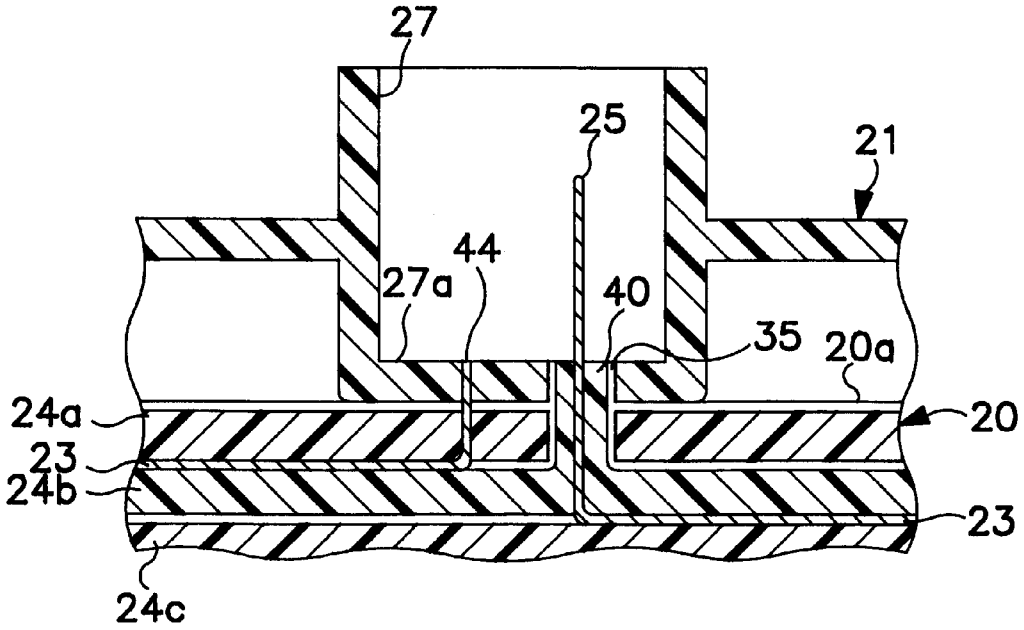
FIG. 7 is a schematic vertical cross-section of an alternative embodiment of the present invention.

As shown in FIG. 7, extension 44 does not have to be formed integrally with a circuit board. Instead, extension 44 extends along the direction in which the circuit boards are stacked and is formed integrally with a bus bar, as is the case with the connector terminals.

Terminal supports 32 do not have to project into the connector mounting openings 27. It would also be possible to have terminal supports 32 project into cavities such as fuse cavities 28 or relay cavities or at some other point on the case. The extensions disposed on circuit board 24*a* or bus bars 23 do not have to be inserted into insertion openings disposed at the bottom of cavities in the case, such as connector mounting openings 27, fuse cavities 28, or relay cavities. It would also be possible to have insertion openings disposed at positions where no opening 27 or cavity 28 is formed. In this case, the relative heights of the extensions and the insertion openings can be easily inspected visually from the front of the case. This makes it possible to easily check the manner in which the case is assembled.

Figure 8:
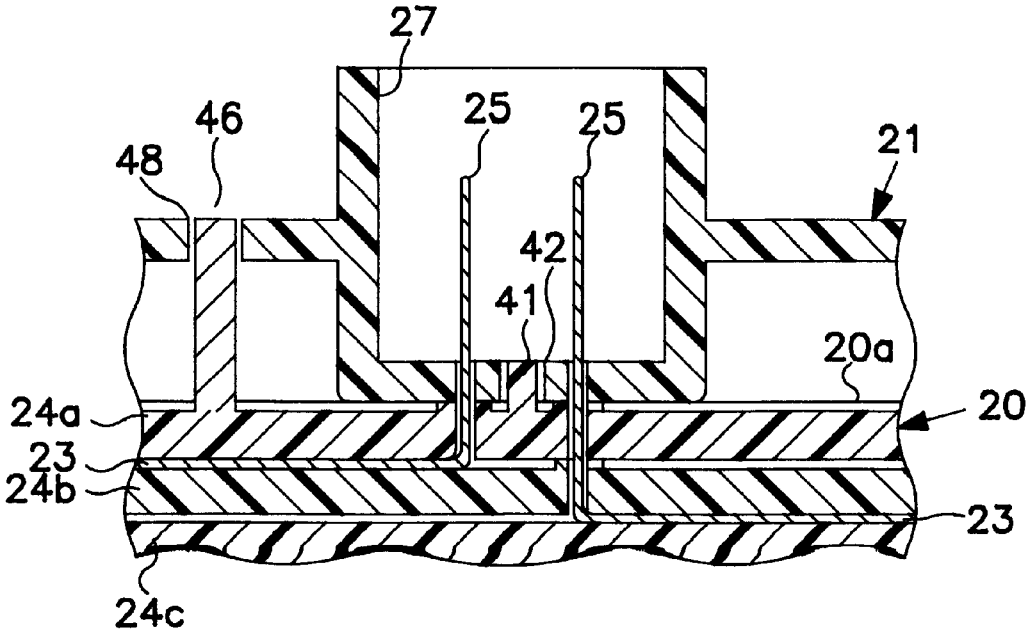
FIG. 8 is a schematic vertical cross-section of a further alternative embodiment of the present invention.

Furthermore, the extension does not have to be integrally formed with circuit boards 24*a*–24*e* or bus bars 23. It would also be possible to have the extension bonded, e.g. through adhesion or welding, to circuit boards 24*a*–24*e* or to bus bars 23, as shown in FIG. 8 with extension 46 extending from circuit board 24*a* through insertion opening 48.

The branching connector can be implemented so that the connector on which connector mounting openings are formed for connection of external connectors is disposed on the same surface as the connector to which electronic parts are connected.

What is claimed is:

1. In a branching assembly having a circuit unit which comprises stacked circuit boards with connecting terminals extending perpendicularly from said circuit unit and a casing in which said circuit unit is housed and through which said connecting terminals extend for connection to electrical components mounted on an outer surface of the casing, the improvements comprising:

extensions, mounted on said circuit unit and extending perpendicularly from said circuit unit in the same direction as said connecting terminals, said extension selected from the group consisting of an extension disposed integrally with one of said circuit boards and not associated with any of said connector terminals; and an extension extending from and being part of one of said connecting terminals; and insertion openings positioned in said casing for receiving said extensions, each said extension having a top surface such that said top surface of said extension and said outer surface of said casing at said insertion opening are coplanar with each other, whereby proper positioning of the circuit unit in said casing can be visually confirmed.

2. The branching connector assembly of claim 1 wherein said extensions are terminal supports integral with an uppermost circuit board through which said connecting terminals are inserted, whereby said terminal supports maintain said connecting terminals substantially perpendicular to said uppermost circuit board.

3. The branching connector assembly of claim 1 wherein said casing has a connector mounting opening on said outer surface and said insertion opening is positioned in said connector mounting opening.

* * * * *